US010144030B2

(12) United States Patent
Fang et al.

(10) Patent No.: US 10,144,030 B2
(45) Date of Patent: Dec. 4, 2018

(54) NEBULIZATION DEVICE WITH SPRAY ORIFICE PLATE

(71) Applicant: MICRO BASE TECHNOLOGY CORPORATION, Bade, Taoyuan County (TW)

(72) Inventors: Tun-Ying Fang, Bade (TW); Yao-Fang Ku, Bade (TW); Yu-Ta Chen, Bade (TW); Mei-Hui Huang, Bade (TW); Yi-Hui Peng, Bade (TW)

(73) Assignee: MicroBase Technology Corp., Taoyuan (TW)

( * ) Notice: Subject to any disclaimer, the term of this patent is extended or adjusted under 35 U.S.C. 154(b) by 282 days.

(21) Appl. No.: 13/845,100

(22) Filed: Mar. 18, 2013

(65) Prior Publication Data

US 2014/0110499 A1 Apr. 24, 2014

(30) Foreign Application Priority Data

Oct. 19, 2012 (TW) ..... 101220206 U

(51) Int. Cl.
*B05B 17/06* (2006.01)
*B05B 17/00* (2006.01)

(52) U.S. Cl.
CPC ..... *B05B 17/0646* (2013.01); *B05B 17/0638* (2013.01); *B05B 17/0653* (2013.01); *B05B 17/06* (2013.01); *B05B 17/0607* (2013.01); *B05B 17/0615* (2013.01)

(58) Field of Classification Search
CPC ..... B05B 17/06; B05B 17/0607; B05B 17/0646; B05B 17/0638; B05B 17/063; B05B 17/0615; B05B 9/00; B05B 1/08
USPC ..... 239/102.1, 102.2, 590, 590.3, 575, 548, 239/552, DIG. 23; 128/200.16
See application file for complete search history.

(56) References Cited

U.S. PATENT DOCUMENTS 7,669,782 B2 * 3/2010 Wang et al. ..... 239/102.1
8,870,100 B2 * 10/2014 Hsieh ..... B05B 17/0646 239/102.1
2002/0162898 A1 * 11/2002 Klimowicz ..... A61M 11/005 239/102.1
2007/0051827 A1 * 3/2007 Shen ..... B05B 17/0646 239/102.2

(Continued)

FOREIGN PATENT DOCUMENTS

TW M425720 U1 11/2011

*Primary Examiner* — Alexander Valvis
*Assistant Examiner* — Christopher R Dandridge
(74) *Attorney, Agent, or Firm* — Laurence Kao; Opes IP Consulting Co., Ltd.

(57) ABSTRACT

Disclosed is a nebulization device with a spray orifice plate including an energy transfer element, a spray orifice plate and a driving element. The energy transfer element has at least one first penetrating hole for inputting a liquid from a side and the spray orifice plate is installed on at least one side of the energy transfer element for sealing the first penetrating hole, and the energy transfer element supports the spray orifice plate, and the spray orifice plate has at least one stepped orifice formed at a position corresponding to the first penetrating hole and serves as a transportation channel of the liquid, so that the liquid can be temporarily stored in the stepped orifice and sprayed out through the through hole after vibration and nebulization in order to improve the nebulization effect significantly.

16 Claims, 7 Drawing Sheets

(56) References Cited

U.S. PATENT DOCUMENTS

| | | | | |
|---|---|---|---|---|
| 2008/0217430 | A1* | 9/2008 | Feriani | B05B 17/0646 239/102.2 |
| 2009/0134235 | A1* | 5/2009 | Ivri | 239/4 |
| 2013/0112770 | A1* | 5/2013 | Hsieh | B05B 17/0646 239/102.1 |
| 2013/0119151 | A1* | 5/2013 | Moran et al. | 239/102.2 |
| 2013/0327855 | A1* | 12/2013 | Mosser | F02M 61/1833 239/601 |

* cited by examiner

NEBULIZATION DEVICE WITH SPRAY ORIFICE PLATE

CROSS-REFERENCE TO RELATED APPLICATIONS

This non-provisional application claims priority under 35 U.S.C. § 119(a) on Patent Application No(s). 101220206 filed in Taiwan, R.O.C. on Oct. 19, 2012, the entire contents of which are hereby incorporated by reference.

BACKGROUND OF THE INVENTION

1. Field of the Invention

The present invention relates to the field of liquid nebulization devices, and more particularly to a nebulization device with a spray orifice plate having at least one first stepped penetrating hole to improve the nebulization effect.

2. Description of the Related Art

A nebulization device with a spray orifice plate is commonly used in nebulizers or ink cartridges and the device produces high-frequency vibration waves based on the principle of electron vibration to break down the molecular structure of a solution such as a medicine, perfume or ink solution into nebulized molecules and sprays out the nebulized molecules.

In general, a conventional nebulization device with a spray orifice plate comprises a driving element and a spray orifice plate, wherein the driving element is installed on a side of a first penetrating orifice plate which is made of metal and has a plurality of nebulization holes formed on a surface of the first penetrating orifice plate. After the driving element is provided with power, high-frequency vibration waves are produced, so that the first penetrating orifice plate is deformed and bent by resonance to break down the molecular structure of a liquid to be nebulized into smaller nebulized molecules, and then the nebulized molecules are sprayed out from the nebulization holes. However, the first penetrating orifice plate is made of metal, and the distance between the nebulization holes is fixed. Since the nebulization holes cannot be manufactured freely, the liquid to be nebulized has a poor chemical resistance which affects the characteristic and performance of the nebulization of the nebulization device with a spray orifice plate. Furthermore, the nebulization plate made of metal may become embrittled and fatigue easily after experiencing the high-frequency vibrations of a long time, so that an energy transfer element may crack or break easily, and the reduced vibration effect will lower the nebulization effect.

Therefore, the structural design of a composite nebulization plate as disclosed in R.O.C. Utility Model No. M425720 entitled "nebulization structure" was introduced, wherein the nebulization structure comprises a driving element, a structural plate and a nebulization plate. The structural plate is installed on a side of the driving element, and the structural plate is substantially in the shape of a circular disk and has a plurality of through holes, and at least one rib formed between the through holes to form a water guiding passage. The nebulization plate is clamped between the driving element and the structural plate and made of a macromolecular polymer to overcome the problems of the metal nebulization plate becoming fatigue, embrittled and corroded easily. The structural plate is combined with the nebulization plate and the driving element by an adhesive to overcome the insufficient rigidity of the nebulization plate which is made of the macromolecular polymer, so as to overcome the problem of the vibration energy failing to achieve the expected nebulization efficiency.

In view of the nebulization plate with a single nebulization hole unable to improve nebulization efficiency, the inventor of the present invention improved the design of the nebulization holes by providing a nebulization plate with stepped nebulization holes to improve the nebulization effect significantly.

SUMMARY OF THE INVENTION

In view of the problems of the prior art, it is a primary objective of the present invention to provide a nebulization device with a spray orifice plate, wherein the spray orifice plate has a plurality of stepped orifices including at least one through hole and at least one recess for temporarily storing a liquid, such that after the spray orifice plate is vibrated, the liquid is nebulized and sprayed out through the through hole to improve the nebulization effect.

Another objective of the present invention is to provide a nebulization device with a spray orifice plate comprising an energy transfer element used as a device for transferring energy of a driving element and as a structural support of the spray orifice plate, and the energy transfer element serves as a transportation channel of the liquid, so as to enhance the availability after the assembling process and improve the nebulization effect effectively.

To achieve the aforementioned objectives, the present invention provides a nebulization device with a spray orifice plate, comprising: an energy transfer element, with two sides defined as an inlet side and an outlet side, and having at least one first penetrating hole formed on the energy transfer element for inputting a liquid from the inlet side; a spray orifice plate, installed on at least one side of the energy transfer element for sealing the first penetrating hole, and the energy transfer element supporting the spray orifice plate, and the spray orifice plate having at least one stepped orifice which is formed at a position corresponding to the first penetrating hole and serves as a transportation channel of the liquid; and a driving element, installed on at least one side of the energy transfer element, for providing the vibration energy required by the energy transfer element after the driving element is provided with power, such that the liquid passing through the first penetrating hole is temporarily stored in the stepped orifice, and then vibrated and nebulized, and finally sprayed out from the outlet side through the stepped orifice. Wherein, is a ring structure made of metal, and the driving element is substantially a ring structure having a second penetrating hole formed thereon, and the second penetrating hole has a diameter greater than or equal to the diameter of the first penetrating hole, and the spray orifice plate is clamped between the energy transfer element and the driving element. Wherein, the spray orifice plate is made of a macromolecular polymer selected from the collection of polyimide, polyethylene (PE), polypropylene (PP) and polyether ether ketone (PEEK).

In different embodiments, the stepped orifice may be in one-step configuration or a multi-step form, and the number of steps is directly related to the thickness of the spray orifice plate.

In a preferred embodiment of the present invention, the stepped orifice has a first groove and at least one through hole, and the first groove is disposed on a side of the spray orifice plate opposite to the inlet side, and the through hole is disposed in the first groove to make the cross-section of the stepped orifice into a one-step configuration. In addition, the first groove has a shape selected from the collection of circular, rectangular, strip, star and cross shapes, and the first groove and the through hole have a depth ratio falling within a range from 1:1 to 4:1.

In another preferred embodiment of the present invention, the stepped orifice has a first groove, at least one second groove and at least one through hole, and the first groove is disposed on a side of the spray orifice plate opposite to the inlet side, and the second groove is disposed in the first groove, and the through hole is disposed in the second groove to make the cross-section of the stepped orifice into a two-step configuration. In addition, the first groove and the second groove have a shape selected from the collection of circular, rectangular, strip, star and cross shapes, and the first groove, the second groove and the through hole have a depth proportion falling within a range from 1:1:1 to 6:5:4.

In a further preferred embodiment of the present invention, the stepped orifice has a first groove, at least one second groove, at least one third groove and at least one through hole, and the first groove is disposed on a side of the spray orifice plate opposite to the inlet side, and the second groove is disposed in the first groove, and the third groove is disposed in the second groove, and the through hole is disposed in the third groove to make the cross-section of the stepped orifice into a three-step form. The first groove, the second groove and the third groove have a shape selected from the collection of circular, rectangular, strip, star and cross shapes. The first groove, the second groove, the third groove and the through hole have a depth proportion falling within a range from 1:1:1:1 to 5:4:3:3. It is noteworthy that the through hole is a conical hole.

DETAILED DESCRIPTION OF THE PREFERRED EMBODIMENTS

Figure 1:
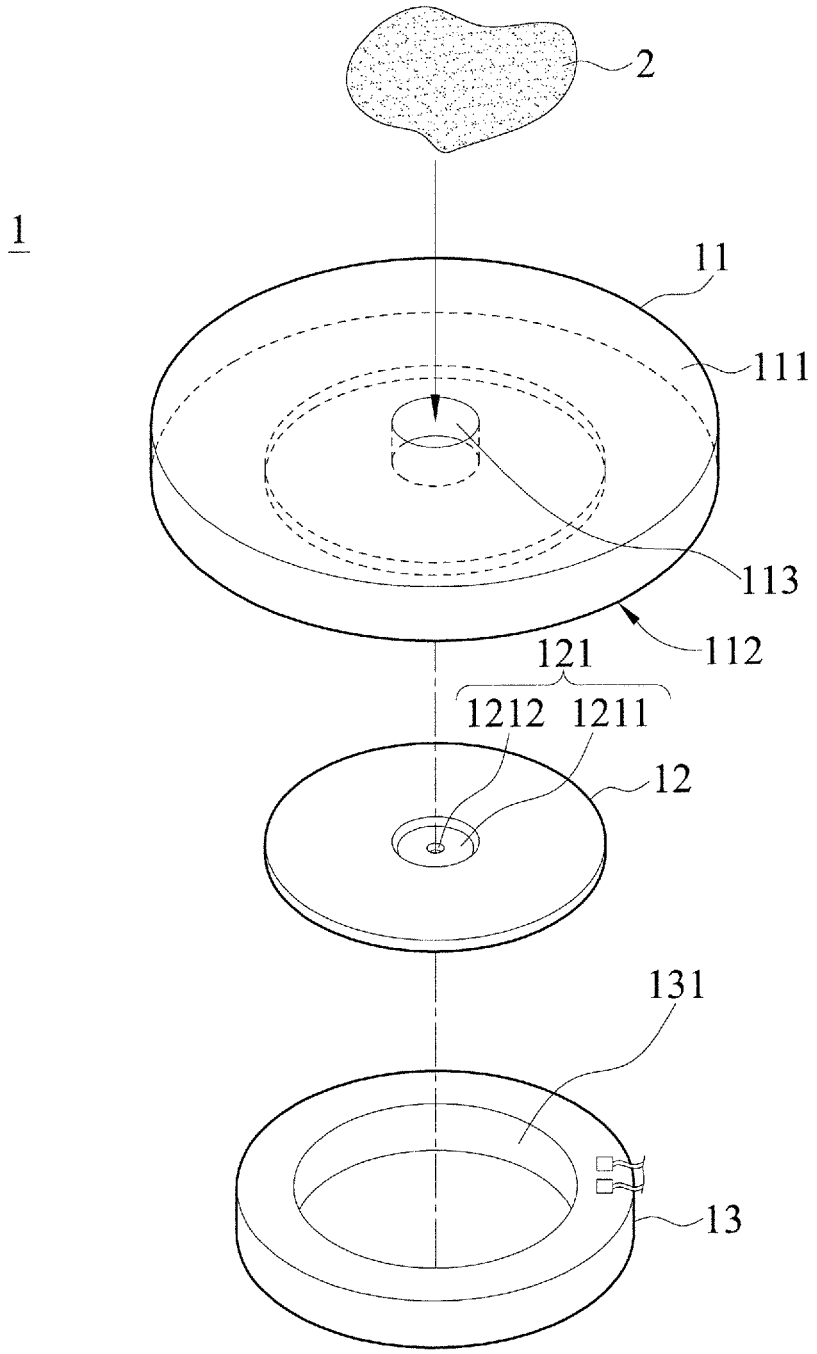
FIG. 1 is a top view of a first preferred embodiment of the present invention.
Figure 2:
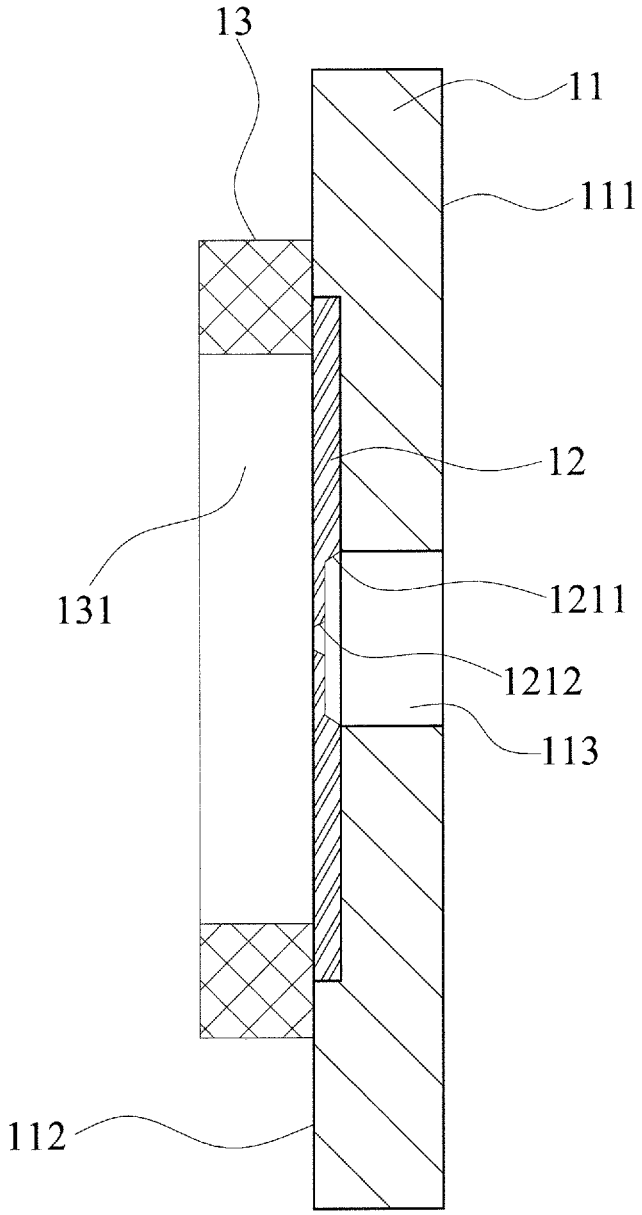
FIG. 2 is a cross-sectional view of the first preferred embodiment of the present invention.

The technical content of the present invention will become apparent with the detailed description of preferred embodiments and the illustration of related drawings as follows.

With reference to FIGS. 1 to 6 for a top view, a cross-sectional view, and different implementation modes of a nebulization device with a spray orifice plate in accordance with the first preferred embodiment of the present invention respectively, the nebulization device with a spray orifice plate 1 comprises an energy transfer element 11, a spray orifice plate 12 and a driving element 13.

Wherein, the energy transfer element 11 is a ring structure made of metal and has an inlet side 111 and an outlet side 112 defined on both sides, and the energy transfer element 11 further has a first penetrating hole 113 for inputting a liquid 2 from the inlet side 111.

Figure 11:
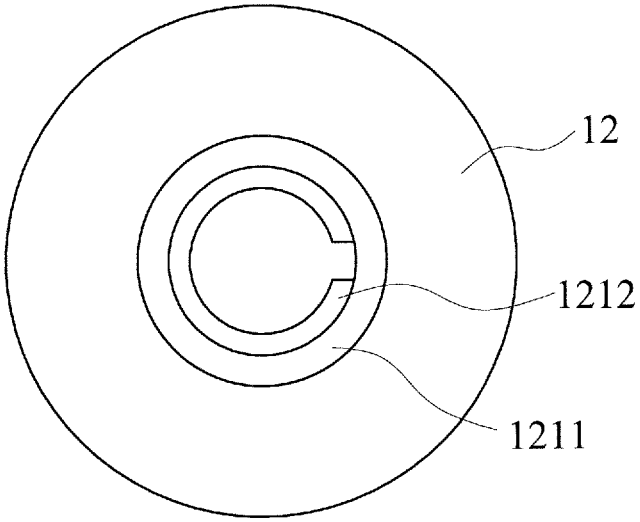
FIG. 11 is a schematic view of a spray orifice plate in accordance with another implementation mode of the first preferred embodiment of the present invention.

The spray orifice plate 12 is made of a macromolecular polymer selected from the collection of polyimide, polyethylene (PE), polypropylene (PP) and polyether ether ketone (PEEK), and the spray orifice plate 12 is installed on a side of the energy transfer element 11 for sealing the first penetrating hole 113. The energy transfer element 11 supports the spray orifice plate 12, and the spray orifice plate 12 has at least one stepped orifice 121 formed at a position corresponding to the first penetrating hole 113 to serve as a transportation channel of the liquid 2. The stepped orifice 121 has a first groove 1211 and at least one through hole 1212, wherein the first groove 1211 is disposed on a side of the spray orifice plate 12 opposite to the inlet side 111, and the through hole 1212 is disposed in the first groove 1211 to make the cross-section of the stepped orifice 121 into a one-step configuration. It is noteworthy that the first groove 1211 has a shape selected from the collection of circular, rectangular, strip, star and cross shapes, and the first groove 1211 and the through hole 1212 have a depth ratio falling within a range from 1:1 to 4:1. Due to the manufacturing process, the through hole 1212 is substantially a conical hole. With reference to FIG. 11 for another preferred embodiment, the through hole 1212 has a shape of a C-shaped ring.

The driving element 13 is also a ring structure having a second penetrating hole 131 formed at the center of the driving element 13, and the second penetrating hole 131 has a diameter greater than or equal to the diameter of the first penetrating hole 113. The driving element 13 is installed on a side of the energy transfer element 11, and the spray orifice plate 12 is clamped between the energy transfer element 11 and the driving element 13, such that the vibration energy required by the energy transfer element 11 can be provided after the driving element 13 is provided with power. The liquid 2 passing through the first penetrating hole 113 is temporarily stored in the stepped orifice 121, and then vibrated and nebulized, and finally sprayed out from the outlet side 112 through the through hole 1211.

Figure 3:
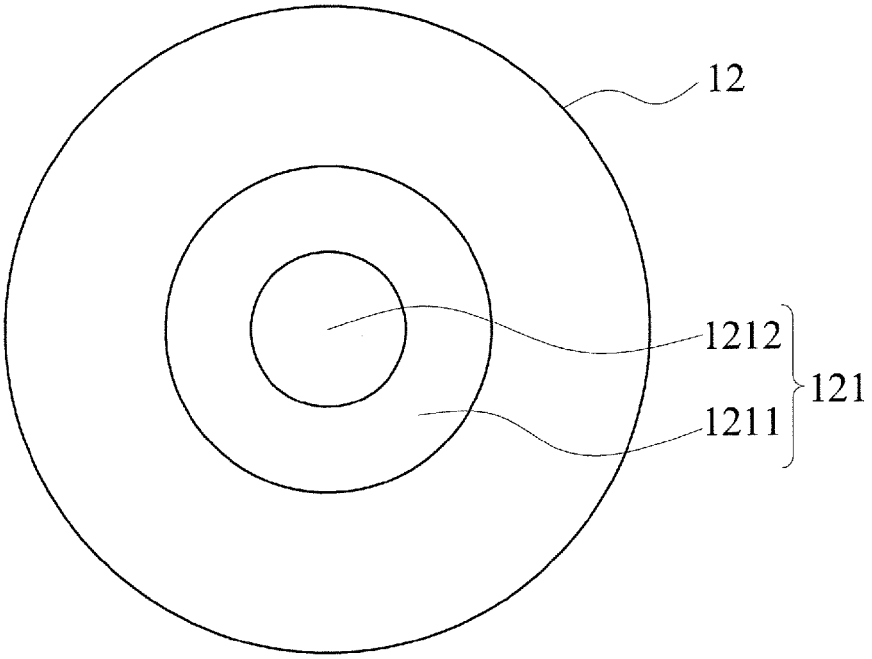
FIG. 3 is a schematic view of a first implementation mode of a spray orifice plate in accordance with the first preferred embodiment of the present invention.
Figure 4:
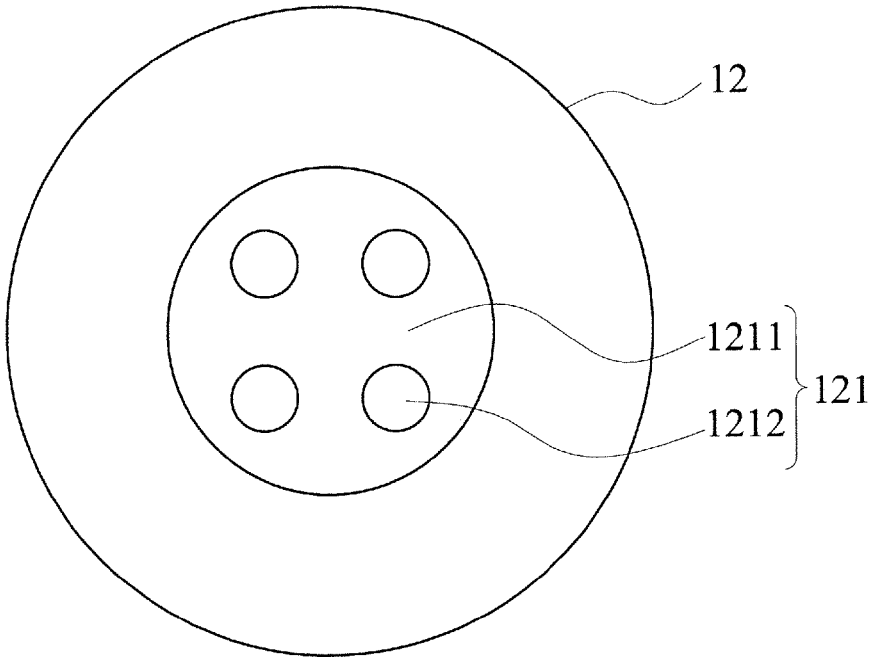
FIG. 4 is a schematic view of a second implementation mode of a spray orifice plate in accordance with the first preferred embodiment of the present invention.
Figure 5:
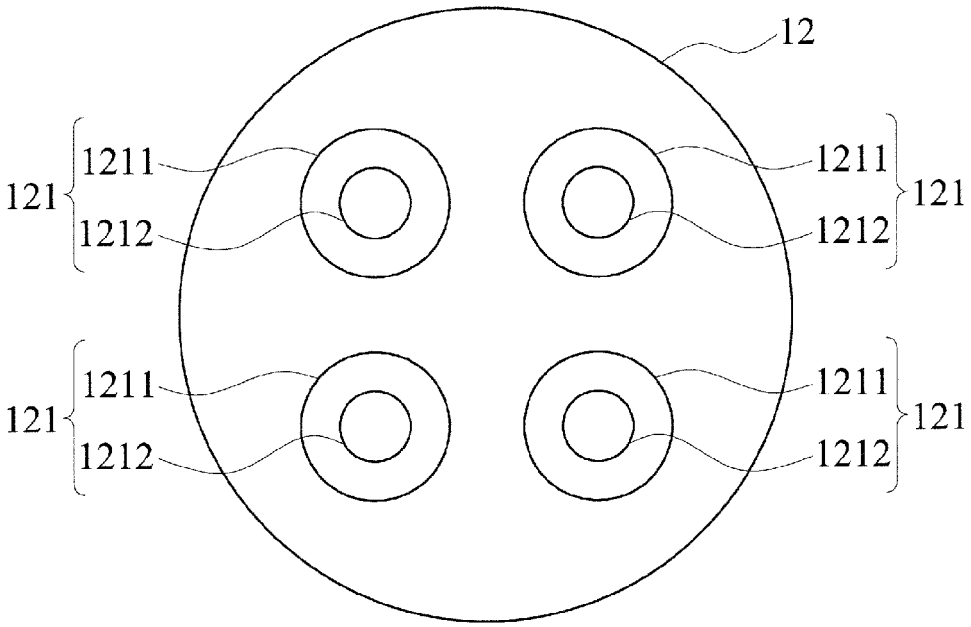
FIG. 5 is a schematic view of a third implementation mode of a spray orifice plate in accordance with the first preferred embodiment of the present invention.
Figure 6:
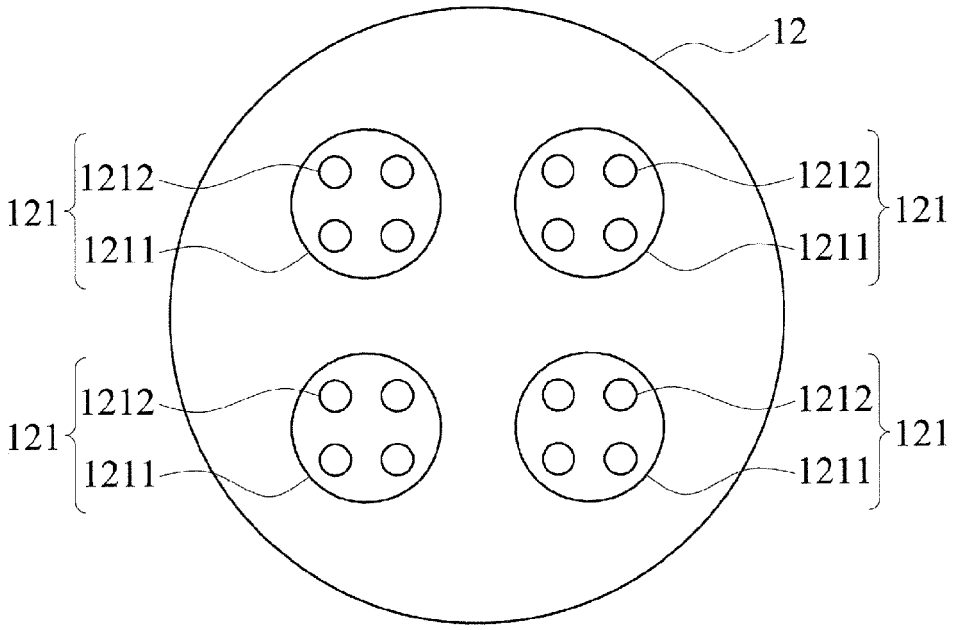
FIG. 6 is a schematic view of a fourth implementation mode of a spray orifice plate in accordance with the first preferred embodiment of the present invention.

With reference to FIG. 3 for a schematic view of a first implementation mode of a spray orifice plate in accordance with the first preferred embodiment of the present invention, the spray orifice plate 12 has a circular stepped orifice 121 formed at the center position of the spray orifice plate 12, and the stepped orifice 121 only has one groove 1211 and one through hole 1212, and the groove 1211 and the through hole 1212 are arranged concentrically with each other. In FIG. 4, the spray orifice plate 12 also has a circular stepped orifice 121 formed at the center position of the spray orifice plate 12, and the stepped orifice 121 has one groove 1211 and a plurality of through holes 1212, wherein the through holes 1212 are distributed evenly in the groove 1211. In FIG. 5, the spray orifice plate 12 has a plurality of circular stepped orifices 121, and each stepped orifice 121 has one groove 1211 and one through hole 1212, and the through hole 1212 of each groove 1211 is concentrically arranged. In FIG. 6, the spray orifice plate 12 has a plurality of circular stepped orifices 121, and each stepped orifice 121 has one groove 1211 and a plurality of through holes 1212, wherein the through holes 1212 are distributed evenly in the groove 1211.

Figure 7:
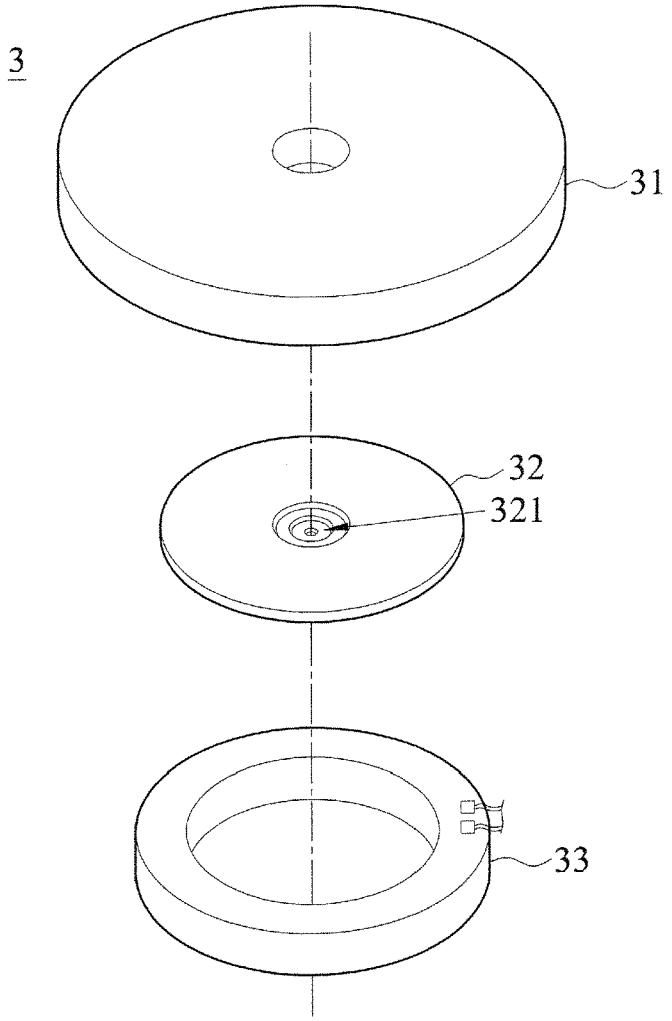
FIG. 7 is a top view of a spray orifice plate in accordance with a second preferred embodiment of the present invention.
Figure 8:
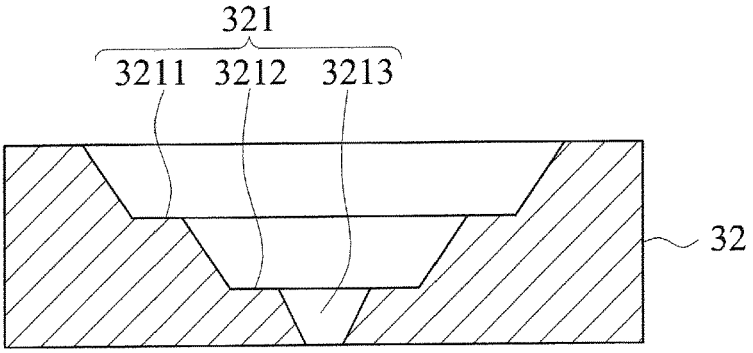
FIG. 8 is a cross-sectional view of a spray orifice plate in accordance with the second preferred embodiment of the present invention.

With reference to FIGS. 7 and 8 for a top view and a cross-sectional view of a spray orifice plate in accordance with the second preferred embodiment of the present invention respectively, a nebulization device with a spray orifice plate 3 of the second preferred embodiment also comprises an energy transfer element 31, a spray orifice plate 32 and a driving element 33, wherein the structure and assembling process of the energy transfer element 31 and the driving element 33 are the same as those described in the first preferred embodiment, and thus will not be repeated. The major difference between the first and second preferred embodiments resides on that the spray orifice plate 32 has one stepped orifice 321 or a plurality of stepped orifices 321, and the quantity of stepped orifices 321 can be increased or decreased as needed. It is noteworthy that the stepped orifice 321 comprises a first groove 3211, a second groove 3212 and a through hole 3213, wherein the first groove 3211, the second groove 3212 and the through hole 3213 are arranged concentrically with one another, and the first groove is disposed on a side of the spray orifice plate 32, and the second groove 3212 is disposed in the first groove 3211, and the through hole 3213 is disposed in the second groove 3212, such that the cross-section of the stepped orifice 321 is in a one-step configuration. In this preferred embodiment, the first groove 3211 is in a cross shape, and the second groove 3212 is in a circular shape. It is noteworthy that the first groove 3211, the second groove 3212 and the through hole 3213 of this preferred embodiment has a depth proportion falling within a range from 1:1:1 to 6:5:4.

Figure 9:
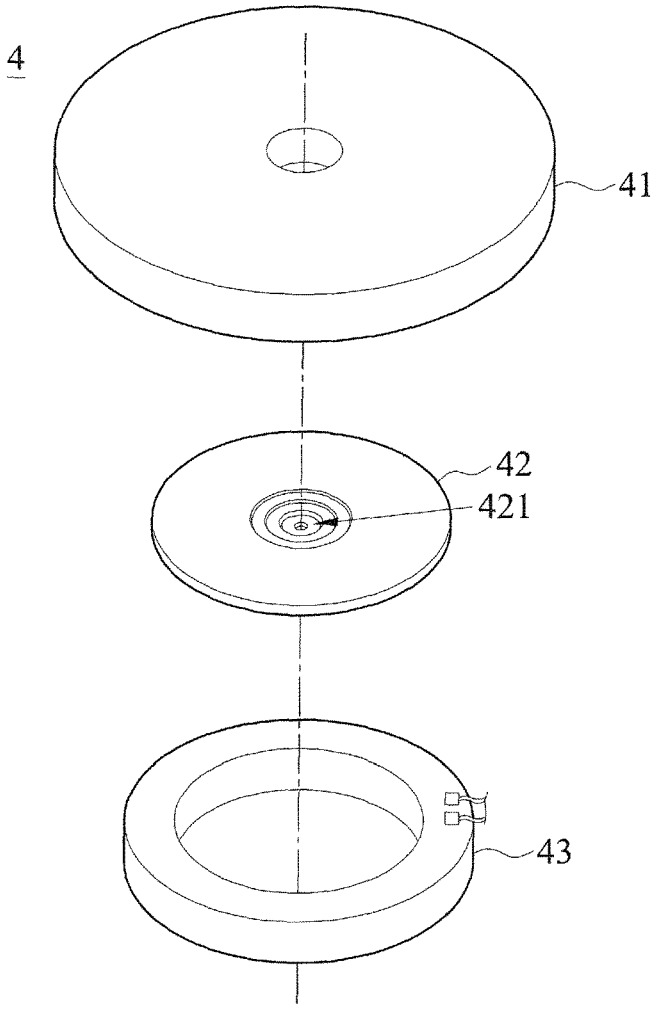
FIG. 9 is a top view of a spray orifice plate in accordance with a third preferred embodiment of the present invention.
Figure 10:
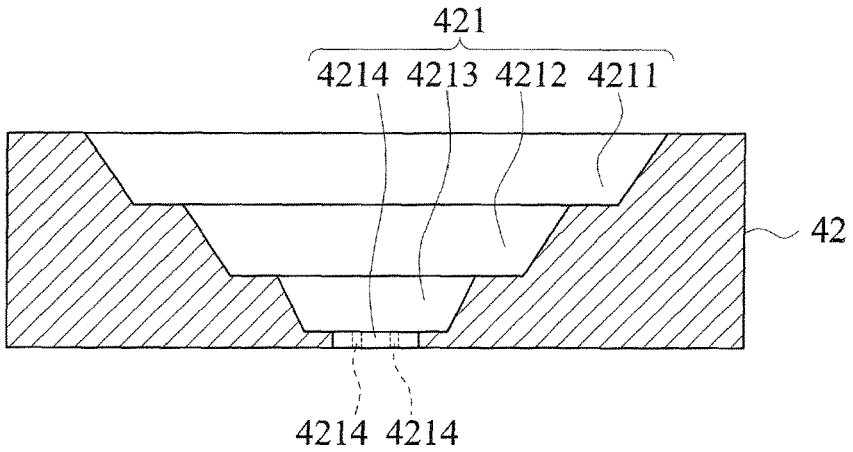
FIG. 10 is a cross-sectional view of a spray orifice plate in accordance with the third preferred embodiment of the present invention.

With reference to FIGS. 9 and 10 for a top view and a cross-sectional view of a spray orifice plate in accordance with the third preferred embodiment of the present invention respectively, a nebulization device with a spray orifice plate 3 of the third preferred embodiment also comprises an energy transfer element 41, a spray orifice plate 42 and a driving element 43, wherein the structure and the assembling process of the energy transfer element 41 and the driving element 43 are the same as those described in the previous embodiments, and thus will not be repeated. The spray orifice plate 42 also has one stepped orifice 421 or a plurality of stepped orifices 421, and the quantity of stepped orifices 421 can be increased or decreased as needed. It is noteworthy that the stepped orifice 421 has a first groove 4211, a second groove 4212, a third groove 4213 and a plurality of through holes 4214, and the first groove 4211, the second grove 4212 and the third groove 4213 are arranged concentrically with one another. The first groove 4211 is disposed on a side of the spray orifice plate 42, and the second groove 4212 is disposed in the first groove 4211, and the third groove 4213 is disposed in the second groove 4212, and the through holes 4214 are distributed evenly in the third groove 4213, such that the cross-section of the stepped orifice 421 is in a three-step form. The first groove 4211, the second groove 4212, the third groove 4213 and the through holes 4214 have a depth proportion falling within a range from 1:1:1:1 to 5:4:3:3.

What is claimed is:

1. A nebulization device with an improved spray orifice plate, comprising:

an energy transfer element, with two sides defined as an inlet side and an outlet side, and having at least one first penetrating hole formed on the energy transfer element, wherein the energy transfer element receives a liquid from the inlet side through the first penetrating hole;

a spray orifice plate having a first surface and an opposite second surface and the first and second surfaces are circular and identical in radius, and the first and second surfaces are entirely flat, and the spray orifice plate is installed on the outlet side of the energy transfer element and seals the first penetrating hole, and the energy transfer element supporting the spray orifice plate, and the spray orifice plate having at least one stepped orifice which is formed between the first surface and the second surface at a position corresponding to the first penetrating hole and serves as a transportation channel of the liquid, wherein the stepped orifice has a groove and at least one through hole, and the groove is disposed on a side of the spray orifice plate opposite to the inlet side, and the through hole is disposed in the groove to make the cross-section of the stepped orifice into a one-step configuration, and the through hole and the first groove is an integrated structure within the spray orifice plate, wherein the at least one stepped orifice penetrates the spray orifice plate from the first surface to the second surface; and a driving ring, installed on the outlet side of the energy transfer element and clamps the spray orifice plate with the energy transfer element, and the driving ring provides the vibration energy required by the energy transfer element so as to vibrate the spray orifice plate after the driving ring is provided with power, such that the liquid passing through the first penetrating hole is temporarily stored in the stepped orifice, and then vibrated and nebulized sprayed out from the outlet side through the stepped orifice, wherein the spray orifice plate is made of one single material of a macromolecular polymer compound.

2. The nebulization device with an improved spray orifice plate according to claim 1, wherein the energy transfer element is a ring structure made of metal, and the driving ring has a second penetrating hole formed thereon, and the second penetrating hole has a diameter greater than or equal to the diameter of the first penetrating hole, and the spray orifice plate is clamped between the energy transfer element and the driving ring.

3. The nebulization device with an improved spray orifice plate according to claim 1, wherein the one single material of the macromolecular polymer compound is selected from the collection of polyimide, polyethylene (PE), polypropylene (PP) and polyether ether ketone (PEEK).

4. The nebulization device with an improved spray orifice plate according to claim 1, wherein the first and second surfaces of the spray orifice plate are entirely flat except at the at least one stepped orifice.

5. The nebulization device with an improved spray orifice plate according to claim 1, wherein the first groove has a shape selected from the collection of circular, rectangular, strip, star and cross shapes.

6. The nebulization device with an improved spray orifice plate according to claim 5, wherein the first groove and the through hole have a depth ratio falling within a range from 1:1 to 4:1.

7. The nebulization device with an improved spray orifice plate according to claim 1, wherein the through hole is a conical hole.

8. The nebulization device with an improved spray orifice plate according to claim 1, wherein the stepped orifice has a first groove, at least one second groove and at least one through hole, and the first groove is disposed on a side of the spray orifice plate opposite to the inlet side, and the second groove is disposed in the first groove, and the through hole is disposed in the second groove to make the cross-section of the stepped orifice into a two-step configuration.

9. The nebulization device with an improved spray orifice plate according to claim 8, wherein the first groove and the second groove have a shape selected from the collection of circular, rectangular, strip, star and cross shapes.

10. The nebulization device with an improved spray orifice plate according to claim 9, wherein the first groove, the second groove and the through hole have a depth proportion falling within a range from 1:1:1 to 6:5:4.

11. The nebulization device with an improved spray orifice plate according to claim 8, wherein the through hole is a conical hole.

12. The nebulization device with an improved spray orifice plate according to claim 1, wherein the stepped orifice has a first groove, at least one second groove, at least one third groove and at least one through hole, and the first groove is disposed on a side of the spray orifice plate opposite to the inlet side, and the second groove is disposed in the first groove, and the third groove is disposed in the second groove, and the through hole is disposed in the third groove to make the cross-section of the stepped orifice into a three-step form.

13. The nebulization device with an improved spray orifice plate according to claim 12, wherein the first groove, the second groove and the third groove have a shape selected from the collection of circular, rectangular, strip, star and cross shapes.

14. The nebulization device with an improved spray orifice plate according to claim 13, wherein the first groove, the second groove, the third groove and the through hole have a depth proportion falling within a range from 1:1:1:1 to 5:4:3:3.

15. The nebulization device with an improved spray orifice plate according to claim 12, wherein the through hole is a conical hole.

16. The nebulization device with an improved spray orifice plate according to claim 1, wherein surface area of the first and second surfaces are identical.

* * * * *